US008709583B2

(12) United States Patent
Schier et al.

(10) Patent No.: US 8,709,583 B2
(45) Date of Patent: Apr. 29, 2014

(54) PVD COATED TOOL

(75) Inventors: Veit Schier, Leinfelden-Echterdingen (DE); Jörg Drobniewski, Herrenberg (DE)

(73) Assignee: Walter AG, Tubingen (DE)

( * ) Notice: Subject to any disclaimer, the term of this patent is extended or adjusted under 35 U.S.C. 154(b) by 260 days.

(21) Appl. No.: 13/144,111

(22) PCT Filed: Mar. 22, 2010

(86) PCT No.: PCT/EP2010/053714
§ 371 (c)(1), (2), (4) Date: Jul. 12, 2011

(87) PCT Pub. No.: WO2010/108893
PCT Pub. Date: Sep. 30, 2010

(65) Prior Publication Data

US 2011/0268514 A1 Nov. 3, 2011

(30) Foreign Application Priority Data

Mar. 23, 2009 (DE) ..... 10 2009 001 765

(51) Int. Cl.
*C23C 30/00* (2006.01)

(52) U.S. Cl.
USPC ..... 428/216; 51/307; 51/309; 428/325; 428/336; 428/469; 428/472; 428/697; 428/698; 428/699; 428/701; 428/702

(58) Field of Classification Search
USPC ..... 51/307, 309; 428/216, 325, 336, 469, 428/472, 697, 698, 699, 701, 702
See application file for complete search history.

(56) References Cited

U.S. PATENT DOCUMENTS

| | | | | |
|---|---|---|---|---|
| 5,879,823 | A | 3/1999 | Prizzi et al. | |
| 6,323,364 | B1 | 11/2001 | Agrawal et al. | |
| 6,333,099 | B1 | 12/2001 | Strondl et al. | |
| 6,565,957 | B2 | 5/2003 | Nakamura et al. | |
| 6,638,609 | B2 | 10/2003 | Nordgren et al. | |
| 6,767,583 | B2 * | 7/2004 | Nordgren et al. | 427/249.19 |
| 6,872,234 | B2 | 3/2005 | Shibata | |
| 7,670,674 | B2 * | 3/2010 | Schier | 428/697 |
| 7,674,520 | B2 * | 3/2010 | Schier | 428/216 |
| 2004/0033393 | A1 | 2/2004 | Nordgren et al. | |
| 2008/0298921 | A1 * | 12/2008 | Sundstrom et al. | 428/336 |

FOREIGN PATENT DOCUMENTS

| | | | |
|---|---|---|---|
| DE | 196 51 592 | A1 | 6/1997 |
| DE | 100 62 594 | A1 | 6/2001 |
| DE | 101 15 390 | A1 | 6/2002 |
| EP | 1 762 637 | A2 | 3/2007 |
| EP | 1 762 638 | A2 | 3/2007 |
| EP | 1 997 938 | A2 | 12/2008 |
| JP | 2002-200516 | | 7/2002 |
| JP | 2003-508362 | | 3/2003 |
| JP | 2007-075990 | | 3/2007 |

OTHER PUBLICATIONS

International Search Report from application PCT/EP2010/053714 dated Apr. 27, 2010.
German Search Report from related German Patent Application No. DE 10 2009 001 765.8 dated Dec. 2, 2009.
International Preliminary Report on Patentability and Written Opinion of the International Searching Authority for International Application No. PCT/EP2010/053714, issued Sep. 27, 2011.
Office Action (and English translation) in Japanese Application No. 2012-501271, dated Feb. 4, 2014.

* cited by examiner

*Primary Examiner* — Archene Turner
(74) *Attorney, Agent, or Firm* — Morgan, Lewis & Bockius LLP

(57) ABSTRACT

The invention concerns a cutting tool comprising a main body and a multi-layer coating applied thereto. To provide improved cutting tools which have increased resistance to comb cracking, tribochemical wear and cratering caused thereby the main body comprises a hard metal which includes 5 to 8% by weight of Co, 0 to 2% by weight of TaC, 0 to 1% by weight of NbC and 89 to 95% by weight of WC with a mean grain size of 1 to 5 μm, and the coating has a first layer of TiAlN having a layer thickness of 1 to 5 μm, and a second layer of aluminum oxide having a layer thickness of 1 to 4 μm, wherein the coating further additionally includes on the second layer of aluminum oxide n alternately mutually superposedly applied layers of TiAlN and layers of aluminum oxide respectively having a layer thickness of 0.1 to 0.5 μm, wherein n relates to each individual layer and is an even number of 0 to 10, and wherein the total layer thickness of the coating is 2 to 16 μm and the coating is produced in the PVD process.

15 Claims, No Drawings

PVD COATED TOOL

RELATED APPLICATION DATA

This application is a §371 National Stage Application of PCT International Application No. PCT/EP2010/053714 filed Mar. 22, 2010, and also claims priority under 35 U.S.C. §119 and/or §365 to German Application No. 10 2009 001 765.8, filed Mar. 23, 2009.

The invention concerns a cutting tool comprising a main body and a multi-layer coating applied thereto.

STATE OF THE ART

The cutting tools used for machining hard materials, for example steel, generally comprise a main body to which a single-layer or multi-layer coating is applied to increase the service lives or also to improve the cutting properties. Materials used for the main body are for example carbide metal, cermet, steel or high speed steel. The coatings frequently include nitridic compounds but also metallic hard material layers, oxide layers and the like. Various processes are used for applying the coating. They include CVD processes (chemical vapour deposition) and PVD processes (physical vapour deposition).

Particularly high demands are made on the tools for certain applications such as for example milling crankshafts or camshafts because of the material properties of the workpiece. In the production of crankshafts or camshafts, cast or forged shafts are generally subjected to further machining by milling. In that situation the crankshaft milling cutters or camshaft milling cutters are subjected to high thermal and mechanical cyclic loadings. In that case the service life of the tools is limited mainly by a combination of comb cracking and subsequent crater erosion wear which begins at the comb cracks.

In the state of the art CVD coated tool steels are known for tools for the above-described high thermal and mechanical cyclic loadings, which tools however have disadvantages in regard to comb cracking resistance because of the high coating temperature. As a result, because of the crater erosion wear which begins at the comb cracks, the per se high resistance of the CVD coated tool steels, in relation to crater erosion wear, is made relative.

When using a nitridic compound for PVD coating of known tool steels, crater formation occurs, caused by tribochemical wear. Tribochemical wear means in that respect that friction occurs at the contact locations between the tool and the machined material in the machining operation, and that results in chemical reactions, as a consequence of which machined material and tool steel change chemically and structurally, whereby tool wear occurs.

Object

The object of the present invention was that of providing cutting tools which are improved in comparison with the state of the art and which have increased resistance to comb cracking, tribochemical wear and crater formation caused thereby.

According to the invention that object is attained by a cutting tool comprising a main body and a multi-layer coating applied thereto, wherein the main body comprises a hard metal which includes 5 to 8% by weight of Co, 0 to 2% by weight of TaC, 0 to 1% by weight of NbC and 89 to 95% by weight of WC with a mean grain size of 1 to 5 μm, and the coating has a first layer of TiAlN having a layer thickness of 1 to 5 μm, and a second layer of aluminium oxide having a layer thickness of 1 to 4 μm, and the coating further additionally includes on the second layer of aluminium oxide n alternately mutually superposedly applied layers of TiAlN and layers of aluminium oxide respectively having a layer thickness of 0.1 to 0.5 μm, wherein n relates to each individual layer and is an even number of 0 to 10, and further optionally has an outer layer ZrN having a layer thickness of 0.1 to 1 μm, wherein the total layer thickness of the coating is 2 to 16 μm and the coating is produced in the PVD process.

The specified mean grain size relates to the tungsten carbide (WC).

Surprisingly it has been found in that respect that the combination of a hard metal with the contents according to the invention of Co, TaC and NbC with a coating comprising at least a respective layer of TiAlN and aluminium oxide ($Al_2O_3$), wherein optionally further layers are applied, which also alternately consist of TiAlN and aluminium oxide, is particularly resistant to comb cracking and crater wear resulting therefrom at high thermal and mechanical cyclic loadings.

In the combination according to the invention of the main body and the coating according to claim 1 it has been found that a larger proportion of cobalt in the main body has the result that the cutting tool is too soft. A proportion of cobalt of less than 5% by weight leads to a cutting tool which can bear lesser mechanical loadings.

The proportions of NbC and TaC serve to adjust the structure and the desired ratio of hardness and toughness.

In regard to the further layers it will be understood that the layer applied to the second layer of aluminium oxide comprises TiAlN. Thus the alternate application of an even number of further layers means that the further layer last applied consists of aluminium oxide.

The advantage of an outer layer of ZrN is that that layer is of a different colour shade in comparison with the main body and the coating of TiAlN and aluminium oxide. when using the cutting surface, due to partial abrasion of the upper layer of ZrN, the relief surfaces acquire wear traces. In that way it is possible to establish with the naked eye whether a cutting edge has already been used.

In a particularly preferred embodiment the main body comprises a hard metal which has 6 to 8% by weight of Co, 1 to 2% by weight of TaC, 0.2 to 0.3% by weight of NbC and WC as the balance. That composition, in combination with the coatings according to the invention, is particularly suitable for high thermal and mechanical cyclic loadings. It does not include any further hard substances.

It is further preferred if the tungsten carbide (WC) in the cutting tool according to the invention has a mean grain size of 2 to 3 μm. The mean grain size of WC influences the ratio of hardness and toughness. A larger mean grain size admittedly leads to greater hardness but at the same time the toughness is severely reduced. A smaller mean grain size admittedly gives rise to greater toughness but at the same time also causes a slight loss of hardness.

In another preferred embodiment the first layer of TiAlN has a layer thickness of 2 to 4 μm and/or the second layer of aluminium oxide has a layer thickness of 1 to 2 μm. A desired ratio of hardness to toughness is set by the layer of TiAlN with the specified layer thickness. The layer of aluminium oxide with the specified layer thickness governs high-temperature and oxidation resistance and thus leads to tribochemical wear resistance.

In a further preferred embodiment the cutting tool includes a coating, wherein the optional further layers which alternately comprise TiAlN and aluminium oxide respectively are of a layer thickness of 0.1 to 0.3 μm and/or the optional outer layer of ZrN has a layer thickness of 0.1 to 0.6 μm. Due to the further layers the coating has more boundary surfaces, which leads to an increase in toughness but not hardness.

It is further preferred that for the additional alternate layers of TiAlN and layers of aluminium oxide, n≤6. Particularly preferably n=2 or n=4. A larger number of layers would admittedly result in an increase in toughness. On the other hand those layers generally involve a compressive stress. A larger number of layers would therefore possibly result in an unstable coating which spalls off. In addition the application of a large number of alternate layers of TiAlN or aluminium oxide respectively in the PVD-process is very complicated and expensive in terms of process engineering so that that also imposes a limit in a large-scale technical situation.

Particularly preferably the total layer thickness of the coating is 2 to 8 μm and particularly preferably 3 to 6 μm. A thinner coating would not have the adequate number of atomic layers to represent good wear protection. Because of the compressive stresses of the individual layers a thicker coating would be less stable and would possibly spall off in particular at the edges.

Preferably the coating has under the outer layer of ZrN a layer of substoichiometric $ZrN_{1-x}$, wherein x is 0.01 to 0.1 and wherein the layer thickness of the layer is between 0.001 and 0.1 μm. The layer of substoichiometric $ZrN_{1-x}$ adheres less well to the upper layer of aluminium oxide than ZrN so that removal of the ZrN layer, together with the subjacent $ZrN_{1-x}$ layer is simplified. As a result wear traces already occur upon first use of the cutting tool, which indicate that the tool is not unused.

Cutting tools have rake surfaces, cutting edges and relief surfaces. According to the invention preferably only the coating at the relief surfaces has an outer layer of ZrN and optionally a layer of substoichiometric $ZrN_{1-x}$ under the outer layer of ZrN.

The different coatings are produced by a procedure whereby firstly the entire cutting tool is coated with ZrN and then the layer of ZrN is removed completely by brushing and/or (cleaning) jetting from the rake surface and generally also from the cutting edge. If the layer of ZrN remains at the rake surface of the cutting tool that can adversely affect the chips being carried away. Removal is also simplified by the application of a layer of substoichiometric $ZrN_{1-x}$ under the outer layer of ZrN as the layer of substoichiometric $ZrN_{1-x}$ adheres less well to a layer of aluminium oxide than the outer layer of ZrN.

Cutting tools are further preferred in which the ratio of Al to Ti in the layers comprising TiAlN is from 60:40 to 70:30 and preferably 67:33. This involves the atomic ratio (at %). That ratio governs particularly good adhesion of the layers of aluminium oxide to the layers of TiAlN and thereby affords a prolonged service life.

The object is further attained by the use of a cutting tool having the above-described properties for cutting inserts or special indexable cutting inserts in crankshaft milling cutters or camshaft milling cutters.

When milling crankshafts a cutting tool is subjected to high temperatures and high speeds as the machine loading is particularly high. That requires a particularly high resistance to sudden cyclic changes in temperature of the cutting tool, which involves a high resistance to comb cracking.

It has surprisingly been found that the combination according to the invention of a main body comprising a hard metal which has 5 to 8% by weight of Co, 0 to 2% by weight of TaC, 0 to 1% by weight of NbC and 89 to 95% by weight of WC, wherein WC has a mean grain size of 1 to 5 μm, and a coating which has at least a first layer of TiAlN having a layer thickness of 1 to 5 μm and a second layer of aluminium oxide having a layer thickness of 1 to 4 μm, wherein in addition the coating further includes on the second layer of aluminium oxide n alternately mutually superposedly applied layers of TiAlN and layers of aluminium oxide respectively involving a layer thickness of 0.1 to 0.5 μm, wherein n relates to each individual layer and is an even number of 0 to 10, wherein the total layer thickness of the coating is 2 to 16 μm and the coating is produced in the PVD process, has particularly good resistance to thermal and mechanical cyclic loadings which occur when milling crankshafts and camshafts.

Further advantages, features and embodiments of the present invention are described with reference to the following Examples.

EXAMPLE 1

In a PVD coating installation Hauzer HTC1000 a cutting tool comprising 8% by weight of Co, 1.15% by weight of TaC, 0.27% by weight of NbC and 90.58% by weight of WC was provided with a 7-layer coating:

1. TiAlN (ratio Ti:Al of 33:67 atomic %) of a layer thickness of 3 μm deposited using an arc
2. aluminium oxide of a layer thickness of 0.6 μm deposited in a reactive magnetron
3. TiAlN (ratio Ti:Al of 33:67 atomic %) of a layer thickness of 0.3 μm deposited in an arc
4. aluminium oxide of a layer thickness of 0.1 μm deposited in a reactive magnetron
5. TiAlN (ratio Ti:Al of 33:67 atomic %) of a layer thickness of 0.3 μm deposited in an arc
6. aluminium oxide of a layer thickness of 0.1 μm deposited in a reactive magnetron
7. ZrN of a layer thickness of 0.2 μm deposited in an arc.

Before the coating operation the substrate was cleaned in alcohol and additionally cleaned with Ar ion bombardment prior to deposition of the layers in the vacuum chamber.

Deposition of the Layers:

1st, 3rd and 5th Layers:

Deposition of TiAlN was effected in an arc with a 65 A vaporiser current per source at 3 Pa nitrogen and with a bias voltage in the DC mode of 40 V and at a temperature of about 550° C.

2nd, 4th and 6th Layers

Deposition of aluminium oxide was effected in a reactive magnetron with a specific cathode power of about 7 W/cm$^2$ at 0.5 Pa Ar and oxygen as the reactive gas (flow about 80 sscm), with a bipolarly pulsed bias voltage (70 kHz) of 150 V and a temperature of about 550° C.

7th Layer

ZrN was deposited in an arc with a 65 A vaporiser current per source at 3 Pa nitrogen and a bias voltage in the DC mode of 40 V and a temperature of about 550° C.

EXAMPLE 2

Comparative Example

A conventional CVD coating was applied to a substrate in accordance with Example 1 for comparison purposes. The coating consisted of the following layers:

1. TiCN of a layer thickness of 5 μm applied in the mtCVD process

2. $\alpha Al_2O_3$ of a layer thickness of 4 μm applied in a high-temperature CVD-process at a temperature of more than 1000° C.

Application was effected in accordance with a standard protocol for thermal CVD. This involves a cutting tool for crankshaft and camshaft milling as is commercially available at the present time.

Test Implementation:

The cutting tools of Example 1 were compared to those of Example 2 in a milling test on a workpiece comprising 25MnCrSi VB6 steel with which crankshafts were manufactured.

Milling was effected at a cutting speed $v_c$ of 146 m/min, with a tooth advance $f_z$ of between 0.12 mm and 0.18 mm. The milling machining operation was effected dry.

Service Lives:

More crankshafts could be milled with the cutting tools according to the invention of Example 1 than with the comparative tools, to the end of the service life. The end of the service life is defined here on the basis of maintaining dimensional accuracy on the component and chip formation. The end of the service life is reached upon a predetermined deviation from the desired dimensions on the component.

| | Crankshafts |
|---|---|
| Example 1 | 704 |
| Example 2 | 581 |

The invention claimed is:

1. A cutting tool comprising a main body and a multi-layer coating applied thereto, wherein the main body comprises a hard metal which includes 5 to 8% by weight of Co, 0 to 2% by weight of TaC, 0 to 1% by weight of NbC and 89 to 95% by weight of WC with a mean grain size of 1 to 5 μm, and the coating has a first layer of TiAlN having a layer thickness of 1 to 5 μm, and a second layer of aluminium oxide having a layer thickness of 1 to 4 μm, and the coating further additionally includes on the second layer of aluminium oxide n alternately mutually superposedly applied layers of TiAlN and layers of aluminium oxide respectively having a layer thickness of 0.1 to 0.5 μm, wherein n relates to each individual layer and is an even number of 0 to 10, and further optionally has an outer layer ZrN having a layer thickness of 0.1 to 1 μm, wherein the total layer thickness of the coating is 2 to 16 μm and the coating is produced in a PVD process.

2. A cutting tool according to claim 1 wherein the main body comprises a hard metal which has 6 to 8% by weight of Co, 1 to 2% by weight of TaC, 0.2 to 0.3% by weight of NbC and WC as the balance.

3. A cutting tool according to claim 1 wherein the main body includes WC having a mean grain size of 2 to 3 μm.

4. A cutting tool according to claim 1 wherein the first layer of TiAlN has a layer thickness of 2 to 4 μm and/or the second layer of aluminium oxide has a layer thickness of 1 to 2 μm.

5. A cutting tool according to claim 1 wherein the additional alternately mutually superposedly applied layers of TiAlN and layers of aluminium oxide have a layer thickness of 0.1 to 0.3 μm and/or the optional outer layer of ZrN has a layer thickness of 0.1 to 0.6 μm.

6. A cutting tool according to claim 1 wherein $n \leq 6$.

7. A cutting tool according to claim 1 wherein the total thickness of the coating is 2 to 8 μm.

8. A cutting tool according to claim 1 wherein the coating has under the outer layer of ZrN a layer of substoichiometric $ZrN_{1-x}$, wherein x is 0.01 to 0.1 and wherein the layer thickness of the layer is between 0.001 and 0.1 μm.

9. A cutting tool according to claim 1 wherein the tool has rake surfaces, cutting edges and relief surfaces and only the coating at the relief surfaces has an outer layer of ZrN and optionally a layer of substoichiometric $ZrN_{1-x}$, under the outer layer of ZrN.

10. A cutting tool according to claim 1 wherein the ratio of Al to Ti in the layers comprising TiAlN is from 60:40 to 70:30.

11. Use of a cutting tool according to claim 1 for cutting inserts or special indexable cutting inserts in crankshaft milling cutters or camshaft milling cutters.

12. A cutting tool according to claim 6 wherein n=2.

13. A cutting tool according to claim 6 wherein n=4.

14. A cutting tool according to claim 7 wherein the total thickness of the coating is 3 to 6 μm.

15. A cutting tool according to claim 10 wherein the ratio of Al to Ti in the layers comprising TiAlN is 67:33.

* * * * *